US005827137A

United States Patent [19]

Ishino

[11] Patent Number: 5,827,137

[45] Date of Patent: Oct. 27, 1998

[54] PORTABLE VOLLEYBALL PRACTICE APPARATUS

[76] Inventor: Edmund S. Ishino, 6676 W. Leawood Dr., Littleton, Colo. 80123

[21] Appl. No.: 852,140

[22] Filed: May 6, 1997

[51] Int. Cl.[6] ..... A63B 69/00

[52] U.S. Cl. ..... 473/459

[58] Field of Search ..... 473/459

[56] References Cited

U.S. PATENT DOCUMENTS

| | | | |
|---|---|---|---|
| D. 289,540 | 4/1987 | Bender | D21/199 |
| 3,897,950 | 8/1975 | Keller . | |
| 4,022,471 | 5/1977 | Keller . | |
| 4,372,561 | 2/1983 | Morgan et al. . | |
| 4,830,382 | 5/1989 | Wheeler . | |
| 4,852,876 | 8/1989 | Scioscia | 473/459 |
| 5,029,853 | 7/1991 | Cunningham . | |
| 5,062,646 | 11/1991 | Crist . | |
| 5,269,533 | 12/1993 | Kellems . | |
| 5,470,056 | 11/1995 | Dennesen . | |
| 5,472,212 | 12/1995 | Bercaw . | |

*Primary Examiner*—William H. Grieb
*Attorney, Agent, or Firm*—Thomas J. Loran

[57] ABSTRACT

An apparatus of a portable volleyball practice net positioned between two vertical supports above the height of a volleyball net, supported on a playing surface, to catch a propelled volleyball and drop the ball to a playing surface. The apparatus is an accessory for practice drills for improving the skills of passing, serving, setting, or attacking.

13 Claims, 4 Drawing Sheets

PORTABLE VOLLEYBALL PRACTICE APPARATUS

BACKGROUND OF THE INVENTION

1. Field of the Invention

This invention relates to a portable volleyball practice net positioned by vertical supports above the height of a volleyball playing net to catch a volleyball and drop the ball to the practice surface during practice drills of developing the skills of passing, serving, setting, or attacking.

2. Description of the Prior Art

The game of volleyball involves serving a ball into an opponent's court and continuing hitting the ball over the net before the ball strikes the playing court surface. During some practice training, where there is no opponent or limited teammates, preventing the ball from passing through the opponents court saves time and allows skills to be honed in spiking, passing, setting, or serving with rapid returning of the ball. There are at least two kinds of volleyball practice devices to return spiked or served volleyballs. One contains a rigid apparatus structure placed in front of the net that rebounds spiked balls at various angles to the person who spiked or a teammate of the person who spiked the ball. This attempts to duplicate the return of the ball by an opposing player. The second type is supported on a playing net, catches the ball, and returns it to the playing surface under the net. The present invention is supported on the playing surface or on the volleyball net supports and catches and drops balls to the playing surface.

U.S. Pat. No. 4,022,471 contains a rigid frame having rigid barriers to return the ball in front of the net or holds a stationary ball in front of the net for spiking. In U.S. Pat. No. 3,897,950 the ball is either held to be hit into the opposing court or returned in the air above the net. A moving ball is not caught by either apparatus and returned to the playing surface.

U.S. Pat. No. 4,372,561 uses a stationary ball, retained by elastic bands, and supported only on a net to be repeatedly struck or spiked. There is no ball motion prior to spiking or catching a ball. U.S. Pat. No. 5,472,212 has frames supporting a practice net that are vertically supported on the net. The patent's apparatus traps the ball in the apparatus and uses the playing net for vertical support and stopping horizontal ball motion by attaching to the playing net with clips. The weight of the frame and the mechanical advantage or torque of the force of a ball striking the frame or apparatus above the playing net places additional leveraged torque resulting in stress and wear on areas of an expensive net. U.S. Pat. No. 5,470,056 uses a similar mounting on a net method for vertical support as above patents and an angled stabilizing extension pole to aid impeding the ball and apparatus when a ball strikes. This stabilizing method assists in reducing some wear on the net on clip like supports but the practice net relies on the playing net to provide direct vertical support. Since placement on a net is required, the patents describing net mounting cannot be used without a playing net.

U.S. Pat. No. 5,062,646 is a complex wall mounted non-portable training apparatus. U.S. Pat. Nos. 5,269,533, 4,830,382, and DES 289,540 are various support stands for volleyball playing nets.

The present invention impedes a spiked, setted, passed, or served volleyball by installing a ball restraining surface suspended between portable vertical practice net support members placed on the playing surface or supported by the volleyball net supports. Using vertical support members provides direct support of the ball impeding and restraining surface without adding weight on the volleyball net or causing wear on the volleyball net. The present apparatus may be used on any flat playing surface and does not require the volleyball playing net for support. Straps attached to the vertical support members stabilize the portable apparatus to the playing surface or the playing net support poles. There is no wear on a playing net.

SUMMARY OF THE INVENTION

The present invention of a portable volleyball practice apparatus includes a net positioned by portable vertical supports on the volleyball court or practice flat surface to catch a spiked, passed, setted, or served volleyball and to drop the ball to the playing surface. The apparatus provides a game playing accessory to teach a variety of volleyball playing skills.

At least two vertical supports are anchored to or rested on the practice or playing surface. A net or similar surface to impede and catch propelled volleyballs is fastened between the vertical supports, extending above the height of a volleyball net. Restraining straps fastened to each vertical support are anchored on the practice surface or to the volleyball court net supports. These straps maintain the apparatus on a court or practice surface by restraining a volleyball's horizontal force that is normal when a volleyball strikes the apparatus. The apparatus can be free standing without a volleyball net system on any playing surface, or with a volleyball net system it can be positioned anywhere along the length of the playing net. The apparatus can be used in a small area indoors or outdoors and with or without a standard volleyball net system.

Another embodiment of the invention is mounting the vertical supports on the volleyball court net supports, extending above these supports. A cable is placed between these vertical supports, above the court net, with the practice net suspended by the cable. Adjustable straps may be used stabilize the net in similar manner as mentioned above.

Another embodiment is placing the first embodiment near a wall and adding a horizontal brace to each vertical support, extending at preferably right angles to contact the wall.

Accordingly, the object of the invention is to provide a portable volleyball practice apparatus not supported by the playing net by having vertical supports and straps to teach a variety of volleyball playing skills.

Another object of the invention is to catch volleyballs in motion and drop them to the court or practice surface.

Another object of the invention is to have vertical support and strap anchors that adapt to any playing court surface.

Another object of the invention is to provide a portable volleyball practice apparatus that can be easily positioned any place along the playing net and having vertical support members attached to the playing net poles.

DETAILED DESCRIPTION OF THE PREFERRED AND OTHER EMBODIMENTS

Figure 1:
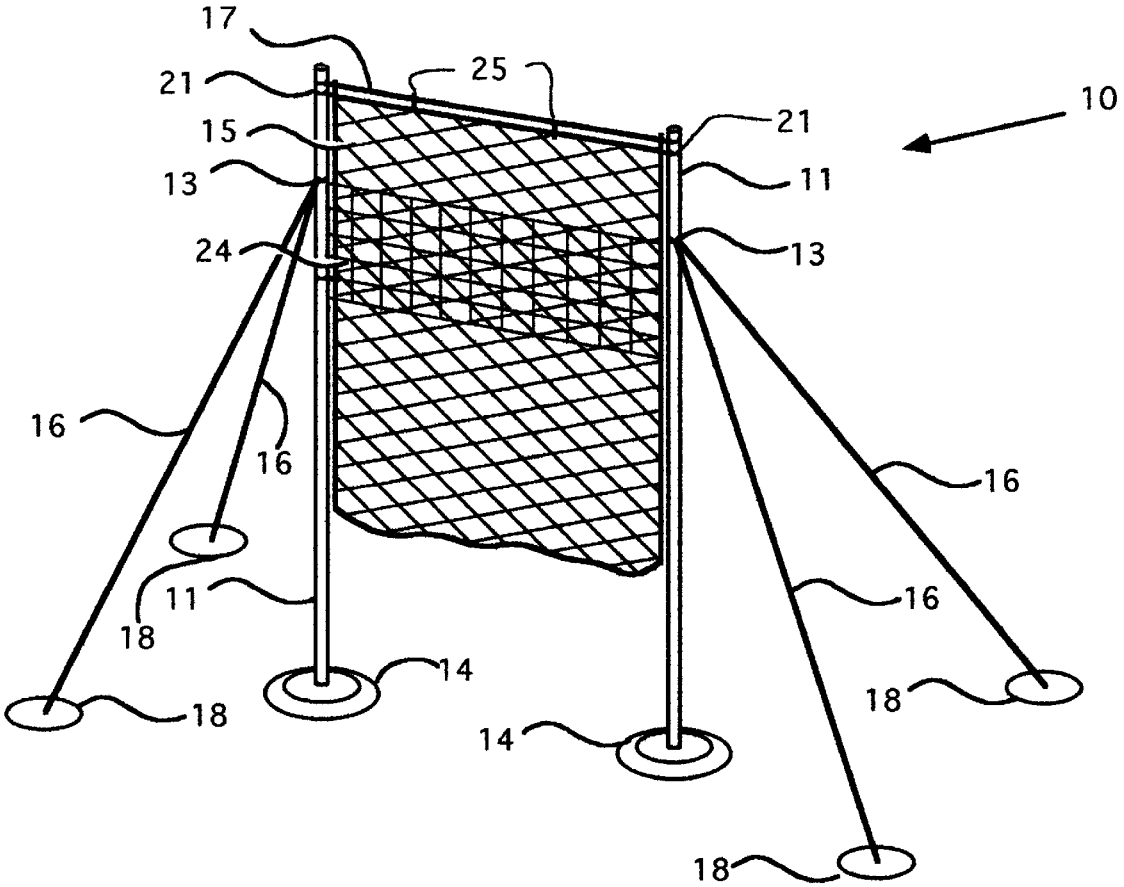
FIG. 1 shows a perspective pictorial drawing of the portable apparatus positioned on a practice surface with the vertical support members and net straps anchored to a court or practice surface.

FIG. 1 shows the portable volleyball practice apparatus 10 that may be positioned on any flat surface for improving a variety of volleyball playing skills. The portable apparatus impedes and catches served, passed, setted, or spiked balls and drops the ball to the practice floor or into a container under the net. The apparatus prevents propelled balls from traveling great distances and aids in retrieving balls. The apparatus 10 includes portable vertical support members 11 placed apart on a playing or practice surface. These vertical support members extend above a volleyball playing net and uphold a surface means 15 for impeding and directing a propelled volleyball down to a practice surface. Each vertical support member bottom has a means 14 for maintaining the vertical support member on a flat surface. A strap means 16 for maintaining the vertical supporting member upright on the practice or playing flat surface is attached to each vertical member, preferably at a height above a playing net, to prevent the vertical member from moving when the means 15 impedes a propelled volleyball. The opposing strap means end is removably attached to the playing or flat surface at an angle. The strap means is anchored to a practice or playing flat surface by an anchor 18. An abbreviated volleyball net 24 or a cable or strap may be placed on the vertical supports to indicate the playing height of a net.

The surface means 15 for impeding a propelled volleyball has opposing ends attached between the vertical support members 11 near the top of the means 11 extending above the top height of a playing net to stop a volleyball that would be propelled over the playing net. This surface means 15 opposing ends are vertically attached to each vertical support member by straps or ties 21, or other clamping means commonly used to anchor nets. The bottom may be limited to the height of a playing net or may extend down to a flat or playing surface. The top of the means 15 extends horizontally above the top height of the playing net at a height distance at least the diameter of a volleyball. Preferably this means 15 is a net, wider and higher than the diameter of a volleyball. Other means 15 for impeding a propelled volleyball and directing the volleyball to the playing surface construction possibilities are synthetic or natural fabrics or blends, or strips of flexible material that absorbs energy produced by a moving ball and allow the ball to fall to the playing surface. A preferred width is about ⅓ the width of the volleyball playing net although longer and shorter widths may be used. The shape of the means 15 for impeding a propelled volleyball may extend below the top of the playing net and may narrow with pleats or folds to aid in directing the ball downward to the playing surface or into a container placed on the playing surface below the playing net.

The top of the means 15 for impeding a propelled volleyball may be attached directly to each vertical support member or attached on a flexible or rigid member such as cable, cord, or rod 17 joining near the top of the vertical support members. When using a cable cord or rod 17, fasteners 25 of ties, clips or clamps, or a sleeve attached to a net may be used. The cable or the net may be removably attached to the vertical support members by ties, clips, clamps, or wires 21 directly on the vertical support members or through slots or openings in the vertical support members. The means 15 for impeding a propelled volleyball or net on a cable produces a preferred horizontal top shape for the means 15 although a rigid curved cable or rod may also be placed between the vertical support members to add additional height to means 15.

The vertical support members 11 preferably are tubes that telescope to ease portability. These members may also be constructed as one piece or sections that when assembled extend above the height of the top of the volleyball net by at least the diameter of a volleyball. Solid or hollow tubes having round, multi-sides, or semi circles are suggested. Other structural shapes including angles, bars, channels, U-shape, T-shape, or elliptical may be used. The vertical support members may be constructed from wood, plastic such as polyvinylchloride, polypropylene, nylon, or other rigid plastic material including reinforced plastics. Metals may also be used including brass, copper, steel, or aluminum or alloys of these materials. Interlocking section pieces may also be used for the assembly of vertical support members. The sections may be interlocked by threads, separate union joints, clamps, collar locks, snap buttons, pins or interlocking slots. The vertical support members can be telescoping to quickly and easily set up and break down for transportation and storage. At least two vertical support members are necessary for the apparatus.

A means 14 for maintaining the vertical support members on a playing surface is positioned under the vertical support members. Singular vertical support member removably connects to the means for maintaining the vertical support so the lower section of the vertical support member is stationary during use. For outdoor use, the earth or sand may be the means 14 for maintaining the support members by placing the members directly into the earth, grass, or sand. Other means for maintaining the vertical supports include a member under each vertical support member including suction cups that secure on the indoor playing surface or base plates that distribute the load on the outdoor playing surface. The means 14 may be solid shapes or hollow for light weight and be filled with rocks, soil, sand, or water to anchor the vertical support members. The means 14 may be connected together to maintain the relative positions of the vertical support members. Removable adhesive strips or elastomer pads may also be used to maintain the vertical support members or the base plates and be placed on indoor court practice or playing surface.

An adjustable length strap means 16 for maintaining the vertical supporting member upright is attached to each vertical member. Each strap means is connected to the upper section of each vertical support. The opposing end is attached at an angle to the flat surface. The strap means may be straps, ropes, cables, made from plastic, metal, or natural fibers and may have elastic sections to maintain a taunt support. The strap may also be rigid members or a plurality of straps attached to each vertical support member. Preferably this strap means is attached to the vertical support member at a position directly above the height of a playing net by clamps 13 or similar removable mechanisms commonly used to secure straps including hook and loop devices, buttons, buckles, clamps, and male with female connections. Outdoor strap opposing end is anchored into the earth, grass, or sand court surface directly with spikes, screws or other devices placed into the earth in front and in back of the apparatus. Indoor strap mounting anchors 18 may use removable device such as a suction cup, tape, or fastened into a playing surface with removable devices such as clips, screws or hooks. One suction cup design is made by Wood's Powr-Grip™ Co., Inc. Laurel, Mont.

Figure 2:
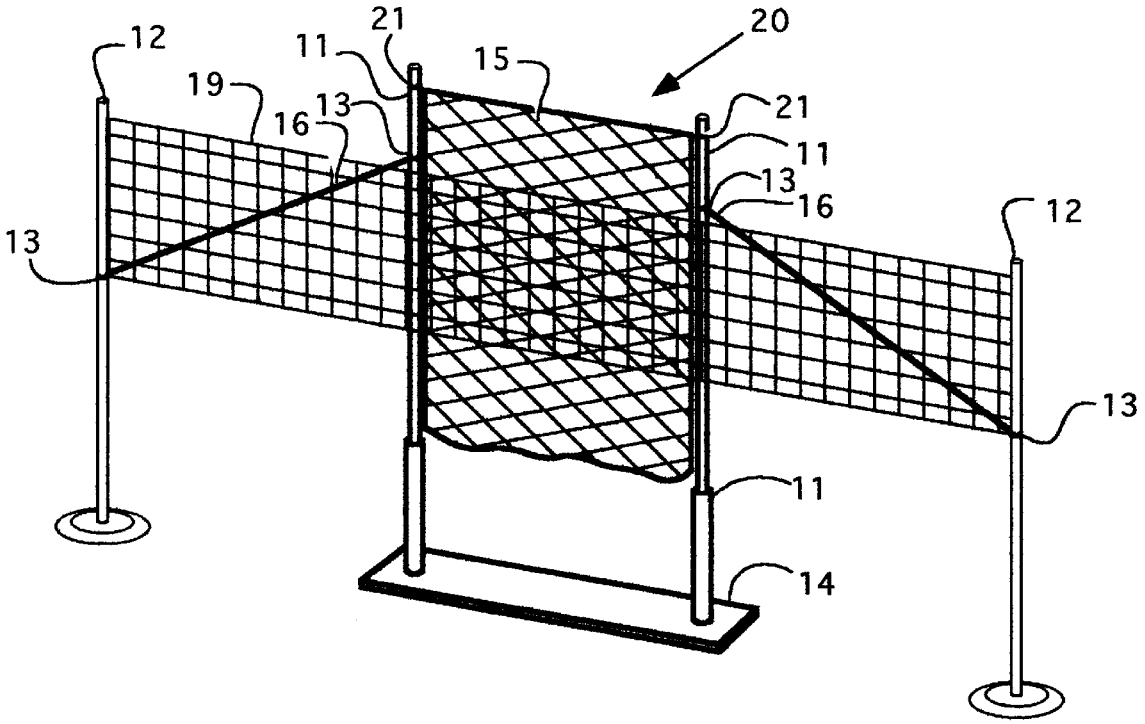
FIG. 2 shows a pictorial drawing of the portable apparatus with telescoping vertical support members positioned near a volleyball net and straps anchored to the playing net pole supports.

A portable volleyball practice apparatus 20 may also be placed between the volleyball court net pole supports, near an erected playing net 19, and on a volleyball court surface as shown in FIG. 2. The surface means 15 for impeding a propelled volleyball is preferably positioned behind the net, generally parallel to the erected volleyball net to impede propelled volleyballs that would pass over the volleyball net. This figure shows telescoping vertical support members 11 and strap means for maintaining the vertical supporting member 16 anchored to the playing net pole supports 12. A single strap means 16 may be attached to each vertical support member as described above with the opposing end attached to a respective playing net pole supports with hook and loop devices or strap attachments 13 described above. The strap may also be anchored to the playing surface using anchors 18. The means 14 for maintaining the vertical support members 11 are shown to be connected together forming a single means for maintaining the vertical support members although they also may separated as shown in FIG. 1.

Figure 3:
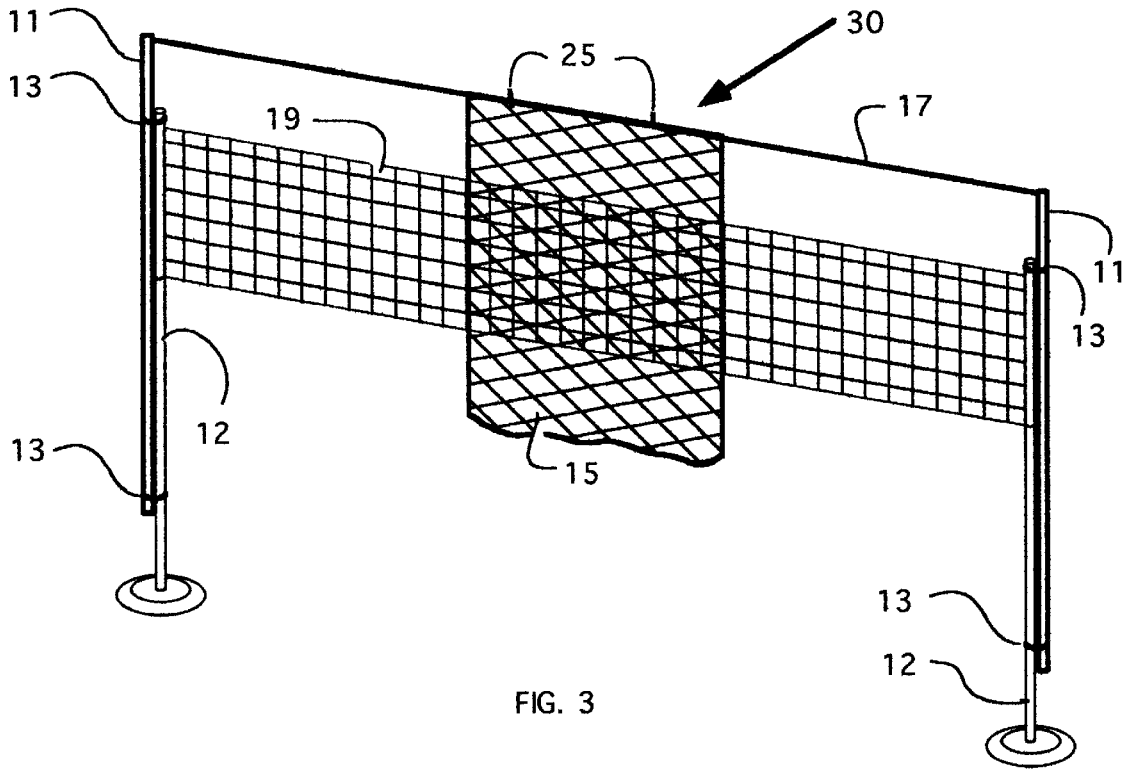
FIG. 3 shows another embodiment with the vertical support members attached to the volleyball playing net pole supports.

Another embodiment of the portable volleyball practice apparatus 30, shown in FIG. 3, is to removably attach the portable vertical support members 11 to the volleyball net pole supports 12. The vertical support member will extend above the net pole supports so to position the means 15 for impeding a propelled volleyball above the height of a playing net by at least the height of the diameter of a volleyball. A cable, strap, or cord 17 attaches between the vertical supporting members above the playing net. The means 15 for impeding a propelled volleyball is movably attached to the cable 17 directly or with ties, clips, or clamps 25 and may be positioned in any location along the volleyball playing net 19. This means 15 may also be positioned at any location along the volleyball net by adjusting cable 17 or adding cords similar to a drapery pulley system and/or permanently fastened to the cable. This means 15 for impeding a volleyball also extends above the top height of the playing net and preferably extends below the top of the net to direct a ball down to the practice or playing surface. Temporary mounting of the practice apparatus on the net support poles may be accomplished with commonly available tension straps or clamps 13 mentioned above for fastening straps that are easily applied and removed. If necessary, spacer blocks between the net support poles and the vertical support members may be used.

Figure 4:
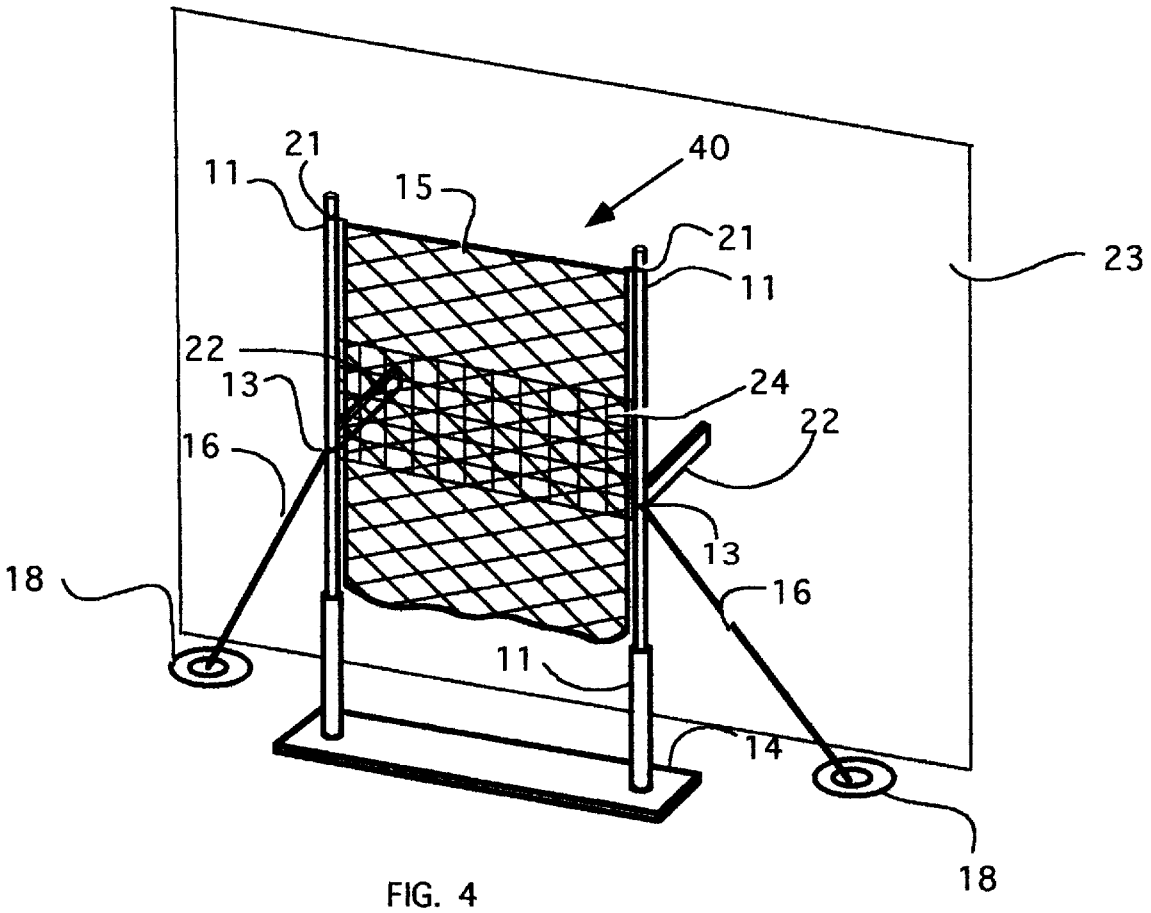
FIG. 4 shows a pictorial drawing of the portable apparatus placed in front of a wall.

FIG. 4 shows the portable volleyball practice apparatus placed in front of a wall 23. Rigid supports 22 and strap means 16 for maintaining the vertical support members maintain the apparatus against a wall. These rigid supports attach to upper section vertical support members 11 and maintain the apparatus next to a wall in a stable position. These supports are removably attached to and may be similar in construction as the vertical support members. The strap means 16 are connected to the vertical support members upper section with opposing ends anchored at an angle to the flat or playing surface. An abbreviated practice net 24 or strap, cord, or cable to simulate playing net height may also be used with this embodiment.

One method of using the practice apparatus is to toss a ball or have a ball tossed in the air in front of the practice apparatus for a player to spike into the apparatus. Another method is to serve balls into the apparatus for practicing serving without sending the ball into other playing areas. Another method is to pass a ball to a practice player setting the ball into the apparatus. Another method is to hit a ball to a player passing the ball into the apparatus.

From the above description of the invention, various changes and modifications to the apparatus will occur to those skilled in the art. All such modifications coming from within the scope of the original or amended claims are intended to be included therein.

I claim:

1. A portable volleyball practice apparatus comprising:

a) two vertical support members placed apart and extending above the height of a volleyball playing net, b) a means for supporting said vertical support members on a flat surface, c) a surface means for impeding a propelled volleyball with opposing ends attached near the top of each vertical support member and, d) a strap means for maintaining said vertical support members upright, connected to the upper section of each said vertical supporting member and opposing end anchored at an angle to said flat surface.

2. A portable volleyball practice apparatus as stated in claim 1 further comprising a cable placed between said vertical support members wherein said means for impeding a propelled volleyball attaches to said cable.

3. A portable volleyball practice apparatus as stated in claim 1 further comprising said surface means for impeding a propelled volleyball extends down, directing the volleyball to said flat surface.

4. A portable volleyball practice apparatus as stated in claim 1 further comprising an abbreviated volleyball net placed between said vertical support members.

5. A portable volleyball practice apparatus as stated in claim 1 wherein said strap means for maintaining said vertical support members upright is a plurality or strap means.

6. A portable volleyball practice apparatus comprising:

a) two vertical support members placed apart, located near an erected volleyball net, b) a means for supporting said vertical support members on a flat surface, c) a surface means for impeding a propelled volleyball with opposing ends attached near the top of each vertical support member and, d) a strap means for maintaining said vertical support members upright, connected to the upper section of each said vertical support member and opposing ends anchored to the volleyball net support poles.

7. A portable volleyball practice apparatus as stated in claim 6 further comprising a cable placed between said vertical support members wherein said means for impeding a propelled volleyball attaches to said cable.

8. A portable volleyball practice apparatus as stated in claim 6 further comprising said surface means for impeding a propelled volleyball extends down, directing the volleyball to said flat surface.

9. A portable volleyball practice apparatus extended above a standard volleyball playing net and having a net of narrow width to be positioned at different locations between erected volleyball net supports to prevent served and hit volleyball passages comprising:

a) a vertical support member connected next to any volleyball net supports and extending above each support of a volleyball playing net, b) a cable connected between said vertical support members positioned above the height of said volleyball playing net to allow change of position of said narrow net and, c) a means for impeding a propelled volleyball attached to said cable.

10. A portable volleyball practice apparatus extended above a standard volleyball playing net and having a net of narrow width to be positioned at different locations between erected volleyball net supports to prevent served and hit volleyball passages as stated in claim 9 further comprising a surface means for impeding a propelled volleyball extends down below said standard volleyball playing net, directing the volleyball to a flat surface.

11. A portable volleyball practice apparatus comprising:

a) two vertical support members placed apart in front of a wall and extending above the height of a volleyball playing net, b) a means for supporting said vertical support members on a flat surface, c) a surface means for impeding a propelled volleyball with opposing ends attached near the top of each vertical support member, d) a horizontal support member attached to each vertical support member and contacting said wall and, e) a strap means for maintaining said vertical support members upright connected to the upper section of each said vertical support member and opposing end anchored at an angle to said flat surface.

12. A portable volleyball practice apparatus as stated in claim 11 further comprising said surface means for impeding a propelled volleyball extends down, directing the volleyball to said flat surface.

13. A portable volleyball practice apparatus as stated in claim 11 further comprising an abbreviated volleyball net placed between said vertical support members.

* * * * *